US008778587B2

(12) United States Patent
Yamaguchi et al.

(10) Patent No.: US 8,778,587 B2
(45) Date of Patent: Jul. 15, 2014

(54) CARRIER FOR ELECTROSTATIC LATENT IMAGE DEVELOPER, ELECTROSTATIC LATENT IMAGE DEVELOPER FORMED OF CARRIER AND TONER, AND PROCESS CARTRIDGE USING THE DEVELOPER

(71) Applicants: Kimitoshi Yamaguchi, Shizuoka (JP); Shigenori Yaguchi, Shizuoka (JP); Toyoshi Sawada, Kanagawa (JP); Hiroshi Tohmatsu, Shizuoka (JP); Hitoshi Iwatsuki, Shizuoka (JP); Toyoaki Tano, Shizuoka (JP)

(72) Inventors: Kimitoshi Yamaguchi, Shizuoka (JP); Shigenori Yaguchi, Shizuoka (JP); Toyoshi Sawada, Kanagawa (JP); Hiroshi Tohmatsu, Shizuoka (JP); Hitoshi Iwatsuki, Shizuoka (JP); Toyoaki Tano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/648,540

(22) Filed: Oct. 10, 2012

(65) Prior Publication Data

US 2013/0101930 A1 Apr. 25, 2013

(30) Foreign Application Priority Data

Oct. 19, 2011 (JP) ..... 2011-229821

(51) Int. Cl.
*G03G 9/107* (2006.01)
*G03G 9/113* (2006.01)

(52) U.S. Cl.
USPC ..... 430/111.33; 430/111.32; 430/111.35; 430/111.41

(58) Field of Classification Search
USPC ..... 430/111.32, 111.33, 111.41, 111.35, 430/111.3, 111.31
See application file for complete search history.

(56) References Cited

U.S. PATENT DOCUMENTS

| | | | | |
|---|---|---|---|---|
| 5,832,350 | A | 11/1998 | Kumasaka et al. | |
| 6,472,118 | B1 | 10/2002 | Yamaguchi et al. | |
| 6,599,672 | B2 | 7/2003 | Yamaguchi et al. | |
| 6,739,534 | B2 | 5/2004 | Yamaguchi et al. | |
| 6,743,558 | B2 | 6/2004 | Yamaguchi et al. | |
| 6,939,654 | B2 | 9/2005 | Kotsugai et al. | |
| 7,192,679 | B2 | 3/2007 | Yamaguchi et al. | |
| 7,592,116 | B2 * | 9/2009 | Suzuki et al. | 430/111.35 |
| 8,039,189 | B2 | 10/2011 | Yamaguchi et al. | |
| 2006/0210905 | A1 | 9/2006 | Imahashi et al. | |
| 2006/0251982 | A1 * | 11/2006 | Iwatsuki et al. | 430/111.1 |
| 2007/0048652 | A1 | 3/2007 | Imahashi et al. | |
| 2008/0227004 | A1 | 9/2008 | Yamaguchi et al. | |
| 2009/0092920 | A1 | 4/2009 | Nagayama et al. | |
| 2010/0233613 | A1 | 9/2010 | Masuda et al. | |
| 2010/0239975 | A1 | 9/2010 | Yamaguchi et al. | |
| 2011/0086307 | A1 | 4/2011 | Nakajima et al. | |
| 2011/0091802 | A1 | 4/2011 | Takahashi et al. | |
| 2011/0171573 | A1 | 7/2011 | Sakata et al. | |
| 2011/0217649 | A1 | 9/2011 | Masuda et al. | |
| 2011/0229817 | A1 | 9/2011 | Yamada et al. | |
| 2012/0009514 | A1 | 1/2012 | Nagayama et al. | |
| 2012/0009518 | A1 | 1/2012 | Nagayama et al. | |
| 2012/0028183 | A1 | 2/2012 | Nakajima et al. | |
| 2012/0057898 | A1 | 3/2012 | Sakata et al. | |
| 2012/0058423 | A1 | 3/2012 | Yamaguchi et al. | |
| 2012/0064451 | A1 | 3/2012 | Kishida et al. | |
| 2012/0230725 | A1 | 9/2012 | Sakata et al. | |
| 2013/0065175 | A1 * | 3/2013 | Sakata et al. | 430/110.2 |

FOREIGN PATENT DOCUMENTS

| | | |
|---|---|---|
| JP | 59-501840 | 11/1984 |
| JP | 7-072733 | 3/1995 |
| JP | 7-092813 | 4/1995 |
| JP | 7-128983 | 5/1995 |
| JP | 9-251237 | 9/1997 |
| JP | 11-065247 | 3/1999 |
| JP | 11-231652 | 8/1999 |
| JP | 2003-043756 | 2/2003 |
| JP | 2004-196574 | 7/2004 |
| JP | 2005-157002 | 6/2005 |
| JP | 2008-175883 | 7/2008 |
| JP | 2009-230090 | 10/2009 |
| WO | WO84/01837 A1 | 5/1984 |

OTHER PUBLICATIONS

U.S. Appl. No. 13/592,626, filed Aug. 23, 2012, Yaguchi, et al.
U.S. Appl. No. 13/556,549, filed Jul. 24, 2012, Sakata, et al.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A carrier for developing an electrostatic latent image, including a particulate core material having a magnetism having developed spontaneous magnetization; and a covering layer comprising an electroconductive material, covering the surface of the particulate core material, wherein the carrier has an electrical resistivity Log R [Ωcm] of from 8.0 to 12.0 when measured by a method, including filling the carrier in a cell containing a pair of facing electrodes, each having a surface area of 2×4 [$cm^2$] with a gap of 2 [mm] therebetween; and applying a DC voltage of 1,000 [V] therebetween to measure a DC resistivity, and a weight-average particle diameter (Dw) of from 25 to 45 μm.

9 Claims, 5 Drawing Sheets

CARRIER FOR ELECTROSTATIC LATENT IMAGE DEVELOPER, ELECTROSTATIC LATENT IMAGE DEVELOPER FORMED OF CARRIER AND TONER, AND PROCESS CARTRIDGE USING THE DEVELOPER

CROSS-REFERENCE TO RELATED APPLICATIONS

This patent application is based on and claims priority pursuant to 35 U.S.C. §119 to Japanese Patent Application No. 2011-229821 filed on Oct. 19, 2011 in the Japanese Patent Office, the entire disclosure of which is hereby incorporated herein by reference.

FIELD OF THE INVENTION

The present invention relates to a carrier for electrostatic latent image developer (two-component developer) used for electrostatic latent image development in electrophotographic image formation, an electrostatic latent image developer formed of the carrier and a toner, and a process cartridge using the developer.

BACKGROUND OF THE INVENTION

In electrophotographic image formation, an electrostatic latent image is formed on a photoconductive image bearer, a charged toner is attached to the electrostatic latent image to form a visual toner image, the toner image is transferred onto a recording medium such as a paper and fixed thereon. Recently, electrophotographic copiers and printers have rapidly developed from monochrome to full-color, and the full-color market is expanding.

Electrophotographic full-color image formation typically uses three primary colors yellow, magenta and cyan toners or four color toners including a black toner, and overlaps each of the color toner images to reproduce all colors. Conventionally, a one-component developing method, a two-component developing method and a hybrid developing methods are used. In order to produce uniform and clear full-color images having good color-reproducibility, a toner amount on an electrostatic latent image bearer needs to be faithfully maintained according to an electrostatic latent image. When the toner amount on the electrostatic latent image bearer varies, the resultant image varies in image density and color tone on a recording medium.

The toner amount on the electrostatic latent image bearer varies because the toner varies in charge quantity and Japanese Patent No. 4337523 (Japanese published unexamined application No. 2005-157002-A) discloses a following image takes over a history of the last image (ghost phenomenon) in the hybrid developing methods. The ghost phenomenon disclosed in Japanese Patent No. 4337523 (Japanese published unexamined application No. 2005-157002-A) is a specific problem of the hybrid developing method. The toner amount on a toner bearer varies according to a toner consumption pattern of the last image and the following image varies in image density. This is because, in the hybrid developing method, a specific amount of a toner is constantly fed to the toner bearer and the amount of a toner thereon varies according to the number of receiving a toner. Namely, after an image consuming less toner is printed, the toner remaining on the toner bearer increases, and after the toner is fed, the toner amount on the toner bearer further increases, and the resultant image has higher image density. Meanwhile, after an image consuming much toner is printed, the toner remaining on the toner bearer decreases, and after the toner is fed, the toner amount on the toner bearer decreases, and the resultant image has lower image density.

As mentioned above, the ghost phenomenon in the hybrid developing method is caused by the toner amount variation on the toner bearer when a following image is produced according to the history of the last image because it is difficult to uniform the amount of the decreased toner after used for development and the amount of the undeveloped toner remaining on the toner bearer when the toner is transferred onto the toner bearer from a two-component developer.

In order to solve these problems, Japanese Patent No. 3356948 (Japanese published unexamined application No. 9-251237-A), and Japanese published unexamined applications Nos. 2005-157002-A and 11-231652-A disclose scraping off the toner remaining on the toner bearer therefrom with a scraper or a toner collection roller after developed and before fed again. Japanese published unexamined application No. 7-72733-A discloses a method of collecting the toner remaining on the toner bearer on a magnetic roller by potential difference between copying or papers to stabilize the toner amount on the toner bearer. Further, in order to solve the problem of history development using the magnetic brush, Japanese published unexamined application No. 7-128983-A discloses widening a half width area of a magnetic flux density of the magnetic roll to collect and feed the toner on the toner bearer. Japanese published unexamined application No. 6-92813-A discloses a method of using a non-spherical carrier to increase the surface area thereof and increasing a ratio of the carriers contacting each other to charge the carrier even at the end of the magnetic brush, narrowing a substantial gap between the developer bearer and the toner bearer to increase the toner amount fed to the toner bearer at a time, and feeding the toner until the toner bearer is saturated with the toner to maintain a specific amount of the toner on the toner bearer and prevent an influence of the last image history.

Even the two-component developing method has the ghost phenomenon. Poor separation of the developer is thought to cause the ghost phenomenon. The two-component developing method has an odd number of magnets in the developer bearer and a pair of magnets having the same polarity below the rotational axis of the developing sleeve to form a separation area where a magnetic force is almost zero. The developer naturally falls there by gravity to separate from the developer bearer. However, the carrier has a counter charge when the toner is consumed in the last image, and an image force generates between the carrier and the developer bearer and the developer does not separate at the separation area. The toner is consumed and the developer having a lowered toner concentration is fed to the developing area again, resulting in production of images having low image density. Namely, images having normal image density are produced for one cycle of the sleeve, but the image density lowers since the second cycle, resulting in the ghost phenomenon. In order to solve these problems, Japanese published unexamined application No. 11-65247-A discloses a configuration of locating a scoop roll having a magnet inside at the separation area above the developer bearer to separate the developer after developed by the magnetic force. The separated developer is further scooped up by another scoop roll, and fed to a developer stirring chamber where the toner concentration is adjusted again and the toner is charged.

Japanese published unexamined application No. 2009-230090-A discloses a long-life two-component developer including a magnetic carrier formed of a core material including a binder resin and a particulate magnetic metal oxide and a coated layer including an ionic liquid, an inorganic particulate material and a binder resin, covering the core material. The developer prevents carrier adherence, has high durability, produces high-quality full-color images, and has no image deterioration such as color contamination even when producing a number of images. Japanese published unexamined application No. 2003-43756-A discloses specifying a mixing ratio of a toner and a carrier formed of a resin in which a magnetic particles are dispersed, a fluidity after magnetized (A) and a fluidity (B) before magnetized or after demagnetized to provide a two-component developer or a supplemental developer having high fluidity, no image deterioration even when producing a number of images and good durability. Japanese published unexamined application No. 4-3868-A discloses a two-component developer using a carrier formed of a magnetic material having a hexagonal magnetoplumbite structure for high-speed development. Japanese published unexamined application No. 2008-175883-A discloses specifying the total amount of excessive $Fe_2O_3$, excessive $Li_2O$ and MgO; a content of atoms besides Li, Mg, Fe and O; and a content of Mn to form a complex ferrite including Li and Mg. The resultant carrier has a light specific gravity, a high resistivity and less variation of properties such as resistivity, magnetization and surfaceness, and a developer using the carrier has durability, reliability and produces less defective images.

Because of these reasons, a need exist for a carrier having good durability, consuming a stable amount of a toner for development without influence of the toner consumption history of the last image, producing uniform images having good color reproducibility for long periods, and preventing background fouling due to toner scattering and carrier adherence.

SUMMARY OF THE INVENTION

Accordingly, one object of the present invention to provide a carrier having good durability, consuming a stable amount of a toner for development without influence of the toner consumption history of the last image, producing uniform images having good color reproducibility for long periods, and preventing background fouling due to toner scattering and carrier adherence.

Another object of the present invention to provide a developer formed of the carrier and a toner.

A further object of the present invention to provide a process cartridge using the developer.

These objects and other objects of the present invention, either individually or collectively, have been satisfied by the discovery of a carrier for developing an electrostatic latent image, comprising:

a particulate core material having a magnetism having developed spontaneous magnetization; and a covering layer comprising an electroconductive material, covering the surface of the particulate core material, wherein the carrier has an electrical resistivity Log R [Ωcm] of from 8.0 to 12.0 when measured by a method, comprising:

filling the carrier in a cell containing a pair of facing electrodes, each having a surface area of 2×4 [$cm^2$] with a gap of 2 [mm] therebetween; and applying a DC voltage of 1,000 [V] therebetween to measure a DC resistivity, and a weight-average particle diameter (Dw) of from 25 to 45 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
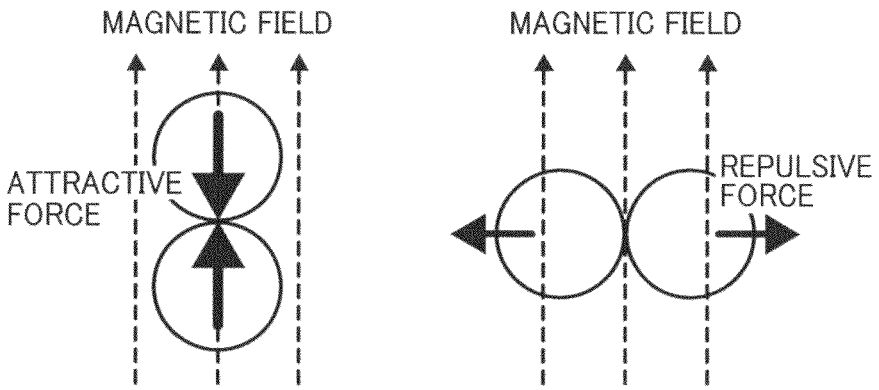
FIG. 1 is a schematic view for explaining an attractive force or a repulsive force between two carriers close to each other in a magnetic field.

The present invention provides a carrier having good durability, consuming a stable amount of a toner for development without influence of the toner consumption history of the last image, producing uniform images having good color reproducibility for long periods, and preventing background fouling due to toner scattering and carrier adherence.

More particularly, the present invention relates to a carrier for developing an electrostatic latent image, comprising:

a particulate core material having a magnetism having developed spontaneous magnetization; and a covering layer comprising an electroconductive material, covering the surface of the particulate core material, wherein the carrier has an electrical resistivity Log R [Ωcm] of from 8.0 to 12.0 when measured by a method, comprising:

filling the carrier in a cell containing a pair of facing electrodes, each having a surface area of 2×4 [$cm^2$] with a gap of 2 [mm] therebetween; and applying a DC voltage of 1,000 [V] therebetween to measure a DC resistivity, and a weight-average particle diameter (Dw) of from 25 to 45 μm.

The occurrence mechanism of the ghost phenomenon in the present invention is thought as follows. When a charged toner is attached to an electrostatic latent image on a photoreceptor (an electrostatic latent image bearer) to form a visual (toner) image in electrophotographic image formation, the toner adheres onto a developer bearer according to the last image history, and a toner development amount of the following image varies according to a potential of the toner having adhered onto the developer bearer. Namely, the ghost phenomenon is caused by variation of the toner development amount of the following image due to the last image history.

In detail, the toner adherence to the developer bearer occurs because the toner is developed onto the developer bearer when a bias is applied in a developing sleeve direction in forming non-image part. The toner developed onto the developer bearer has a potential and the toner development amount increases by the potential thereof in printing. The toner developed onto the developer bearer is consumed in development and the toner amount on the developer bearer is not constant and varies according to the history of the last image. Namely, when the last image has no image or between papers, a toner is developed on the developer bearer and adheres thereon, resulting in higher image density. When the last image has a large image area, a toner on the developer bearer decreases, resulting in lower image density.

The object of the present invention is a phenomenon in which a toner development amount on a developer bearer varies according to the last image, resulting in variation of image density of the following image.

First, the spontaneous magnetization of the particulate core material in the present invention is explained.

The particulate core material for the carrier is typically a polycrystalline ferromagnetic material or a ferrimagnetic material formed of assembled small single crystal (crystal particles). According to the size of the single crystal, they are separated into some magnetic sections (small magnets), and as a unit of single crystal or whole particulate core material, the magnetic sections are arranged so as not to develop magnetization outside to maintain low energy. Therefore, when a magnetic field is applied, the magnetic sections in the single crystal are arranged in a magnetic field direction, the single crystal, each of the particulate core material (assembly of the single crystal), and further the particulate core materials are magnetized.

The particulate core material of the present invention has slight magnetization before a magnetic field is applied as a single crystal level or a particulate core material unit. Namely, only a part of the polycrystalline particulate core material is locally magnetized, and the particulate core material develops spontaneous magnetization.

That the particulate core material is spontaneously magnetized is substantially the same as that small magnets are located on all over the surface of the carrier. Each of the spontaneous magnetizations is small, and their locations and directions are random. At a position which is far by a distance larger than the size of the particulate core material, the spontaneous magnetizations are averaged and a magnetization per particulate unit is not searched. However, in a small area close to the particulate core material, the local spontaneous magnetization causes a magnetic attractive force, resulting in chained carriers or magnetic aggregation. Further, adherence or frictional force between the core materials or the carrier increases, or fluidity (fluidity test method JIS-Z2502) thereof deteriorates.

A main mechanism of the ghost phenomenon is that a toner developed onto the developer bearer has a potential and the toner development amount increases by the potential thereof in printing. The carrier using the particulate core material having a spontaneous magnetization of the present invention largely improves the ghost phenomenon. This is thought to be because of the following reason.

When the developer density filled on a developing sleeve is small and a magnetic brush is not dense, a toner on the developer bearer is easy to transfer in printing and the toner development amount increases eventually, resulting in the ghost phenomenon. Against this, a doctor gap is effectively expanded to increase a pumping amount, but as it is known well a developer has shorter life and filming over a photoreceptor tends to occur when the pumping amount is simply increased. Therefore, high-speed machines and full-color developing machines are difficult to use this method.

The chained carrier using a particulate core material having a spontaneous magnetization and magnetic aggregation largely improves the ghost phenomenon. The reason why the magnetic aggregation prevents the ghost phenomenon is not clarified yet, but it is thought to have the same effect when the pumping amount is increased.

A force generated between two carriers in a magnetic field is represented by the following formula:

$$H=(3M/4\pi^3)(3\cos^2\theta-1)^2 \quad \text{(I)}$$

wherein θ represents an angle relative to a normal direction of the magnetic field: r represents a distance between the carriers; and M represents a magnetization per one carrier=m×v×p wherein m represents a magnetization (emu/g), v represents a volume of the carrier and p represents a true specific gravity ($g/cm^3$).

(1) When two carriers are close to each other in a magnetic field, a repulsive force of $-M^2/4\pi r^3$ is generated therebetween perpendicular to the magnetic field direction (in a developing sleeve direction).

(2) In a developing area, the magnetic field in a tangent direction of the developing sleeve is small, and a distance between the carriers expands when a repulsive force is applied to the carrier, resulting in possible coarse brush.

(3) The repulsive force becomes large when the magnetization m (emu/g), v (volume=particle diameter) and the true specific gravity (ρ) are large, i.e., the magnetization per one carrier is large.

(4) The carrier aggregation (such as physical adherence and magnetic aggregation) cancels the repulsive force and prevents the brush from having thin density.

Namely, a particulate core material having a magnetism having developed spontaneous magnetization is thought to make a carrier develop a suitable spontaneous magnetization and agglutinate to decrease a repulsive force between the carriers in a tangent direction of the developing sleeve and prevent a developer from being thin on the sleeve. Therefore, toner adherence to the sleeve, and release and dispersion of the toner from therefrom in a developing area can be prevented to largely decrease the ghost image. The carrier having developed a spontaneous magnetization has less toner adherence to the sleeve even besides the developing area thereon. Further, toner scattering and background fouling due to toner scattering can be prevented. This is thought to be because the carrier aggregation blocks in the toner. Further, the carrier having aggregability substantially has a large particle diameter and adherence thereof can be prevented.

The carrier of the present invention preferably has an electrical resistivity Log R [Ωcm] of from 8.0 to 12.0 when measured by a method mentioned later. When less than 8.0 in an electric field intensity of 1000 V/2 mm, the carrier adherence tends to occur. When greater than 12.0, a counter charge generated by toner consumption of the last image remains on the carrier and the developer is difficult to normally release from a developer releasing pole. As a result, a developer having low toner concentration is fed to a developing area again. Namely, the image density is normal for one cycle of the sleeve, but lowers from the second cycle thereof.

The electrical resistivity of the carrier can be measured by the following method.

Figure 2:
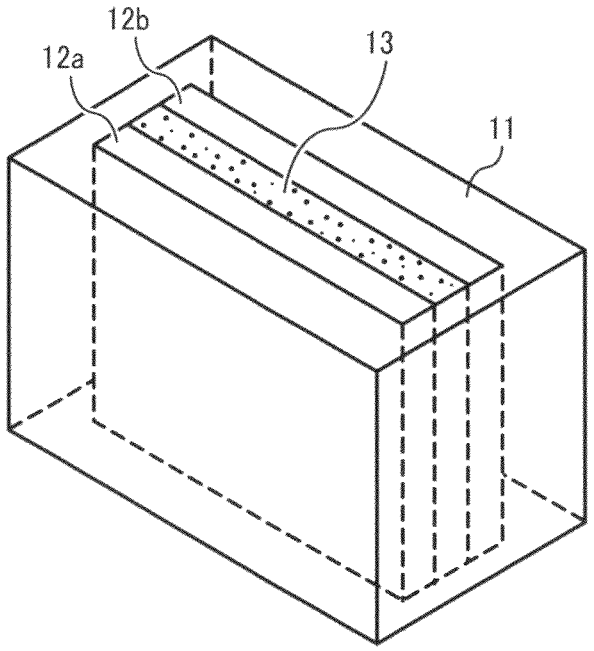
FIG. 2 is a skeleton framework of a cell used for measuring an electrical resistivity in the present invention.

As shown in FIG. 2, a carrier 13 is filled in a cell 11 formed of a fluorocarbon resin container containing electrodes 12*a* and 12*b* having a distance therebetween of 2 mm and a surface area 2×4 cm, a DC voltage of 1,000 V is applied therebetween and a DC resistivity is measured by a High Resistance Meter 4329A from Hewlett-Packard Development Company, L.P. to determined the electric resistivity Log R (Ωcm).

The carrier was placed in the cell until overflowed, after the cell was tapped for 20 times, the upper surface of the cell was horizontally scraped one time with a non-magnetic flat paddle along the edge. The carrier does not need pressing when placed in the cell.

The resistivity of the carrier can be controlled by controlling the resistivity and thickness of a coated resin layer on the particulate core material, or adding an electroconductive fine powder to the coated resin layer.

The carrier of the present invention preferably has a weight-average particle diameter (Dw) of from 25 to 45 μm. When less than 25 μm, the carrier adherence tends to occur. When greater than 45 μm, as the above-mentioned formula (I) shows, the repulsive force between the carriers becomes large, resulting in noticeable occurrence of the ghost phenomenon.

The weight-average particle diameter Dw can be determined by the following formula (II):

$$Dw=\{1/\Sigma(nD^3)\}\times\{\Sigma(nD^4)\} \quad \text{(II)}$$

wherein D represents a representative diameter (μm) present in each channel and n represents a total number of particles present therein.

The channel is a length equally dividing a scope of particle diameters in the particle diameter distribution, and the length is 2 μm for the carrier of the present invention. The representative diameter present in each channel is a minimum particle diameter of the particles present in each channel.

In addition, the number-average particle diameter Dp of the carrier or the core material thereof is determined according to the particle diameter distribution measured on a number standard. The number-average particle diameter Dp can be determined by the following formula (III):

$$Dp=\{1/N\}\times\{\Sigma nD\} \quad \text{(III)}$$

wherein N represents a total number of particles measured, n represents a total number of particles present in each channel and D represents a minimum particle diameter of the particles present in each channel (2 μm).

A particle size analyzer MICROTRAC HRA 9320-X100 from Honeywell, Inc. is used to measure a particle diameter distribution of the carrier under the following conditions:

(1) Scope of particle diameter: 100 to 8 μm
(2) Channel length (width): 2 μm
(3) Number of channels: 46
(4) Refraction index: 2.42

The spontaneous magnetization is developed by the following method.

The magnetization of the ferromagnetic material or the ferrimagnetic material is caused by a magnetic moment of an atom. An atomic magnetic moment maintains the same direction until having a specific assembly unit. Therefore, the single crystal (single magnetic section particle) having the same size can develop a spontaneous magnetization. Namely, the single crystal is a small magnet. When the particulate core material develops a spontaneous magnetization, not only the single magnetic section particles but also an area or a place where single magnetic section particles having a large particle diameter and multiple magnetic section particles having a small particle diameter are mixed develops the spontaneous magnetization. The single magnetic section particles typically have a diameter of from sub μm to a few μm. As mentioned above, an area where intermediate sizes between the single magnetic section particles and the multiple magnetic section particles, i.e., 1 to 10 μm (pseudo-single magnetic section particles) are present has a spontaneous magnetization.

The sizes of the pseudo-single magnetic section particles are different from each other according to the magnetic material composition, preparation conditions, additives and the amount.

Known magnetic materials can be used for the core material of the carrier of the present invention, provided they develop a spontaneous magnetization. Specific examples thereof include, but are not limited to, ferromagnetic materials such as iron and cobalt; magnetite; hematite; and ferrites such as Li ferrite, Mn—Zn ferrite, Cu—Zn ferrite, Ni—Zn ferrite, Ba ferrite and Mn ferrite.

The ferrite is a burned compact constituted of a perfect mixture of divalent metal oxide and trivalent iron oxide, which has the following formula:

$$(MO)_x(NO)_y(Fe_2O_3)_z \quad \text{(a)}$$

wherein x+y+z=100 mol %; and M and N are metal atoms such as Ni, Cu, Zn, Li, Mg, Mn, Sr and Ca.

Among these, Mn Mg Sr ferrites, Mn ferrites and magnetite are preferably used. Namely, a magnetic material formed of Mn Mg ferrites, Mn Mg Sr ferrites or Mn Mg Ca ferrites is preferably used. The magnetic material may include additives such as $P_2O_5$, $Al_2O_3$, $SiO_2$, $Bi_2O_3$, $ZrO_2$, $B_2O_2$, BaO, $TiO_2$, $Na_2O$, PbO and $Y_2O_3$. All of Mn Mg ferrites, Mn Mg Sr ferrites and Mn Mg Ca ferrites develop spontaneous magnetizations and form a suitable-size magnetic aggregation to prevent the ghost phenomenon. Particularly, Mn Mg Sr ferrites and Mn Mg Ca ferrites have very good spontaneous magnetizations even without being magnetized. Mn Mg ferrites have good spontaneous magnetizations and very good spontaneous magnetizations when magnetized.

Particularly, the particulate core material, on the surface of which a single phase of magnetoplumbite ferrite or calcium ferrite is partially formed preferably develops a spontaneous magnetization. The particulate core material, on the surface of which a single phase of calcium ferrite such as $2CaOFe_2O_3$, CaO $Fe_2O_3$ and $CaO_2Fe_2O_3$ preferably develops a spontaneous magnetization and effectively prevents the ghost image. The particulate core material, on the surface of which a single phase of magnetoplumbite ferrite such as M(Sr, Ba, Pb, etc.)O.6$Fe_2O_3$ preferably develops a spontaneous magnetization as well.

The particulate core material, on the surface of which a single phase of magnetoplumbite ferrite such as M(Sr, Ba, Pb, etc.)O.6$Fe_2O_3$ has a hexagonal crystalline form (the shape of a hexagonal plate) and different magnetizations according to directions of crystal axes. Namely, the particulate core material has magnetic anisotropy and has the largest magnetization in a direction perpendicular to the hexagonal surfaces. As a result, spontaneous magnetizations develop at the single phase and its circumferential area. A carrier using the core material having this spontaneous magnetization largely prevents the ghost image.

The spontaneous magnetization relates to magnetic properties of the particulate core material, and it is likely the properties are thought to be clarified using a conventional oscillation magnetometer. The magnetometer does not bring any effective information about the particulate core material or the carrier having local small magnetizations in random directions because of measuring a magnetic force thereof filled in the cell while applying a magnetic field in a specific direction. Methods of observing a magnetic section of a microscopic area include a bitter method using a magnetic colloid solution, a method of using an electron microscope, a method of using magneto-optical effect, a method of using a magnetic force microscope, etc. However, neither of them is suitable for grasping properties and behavior of the particulate core material of the carrier of the present invention. The magnetic force microscope can advantageously observe the magnetic section with ease, but detects a magnetic force between magnetic materials as a principle, and a magnetic field formed by a probe of the microscope largely disturbs the spontaneous magnetization of the carrier of the present invention. This is why the information of the spontaneous magnetization cannot be obtained.

The spontaneous magnetization of the particulate core material or the carrier is effectively evaluated by directly and quantitatively observing the magnetic aggregation. Particularly, the magnetic aggregation is preferably evaluated in water a surfactant is added to as follows.

(1) In a glass bottle having a capacity of 30 cc, 20 cc of an aqueous solution of a straight-chain alkylbenzene sulfonic acid salt (solid content of 27%) is placed as a surfactant.

(2) 0.3 g of a sample are placed in the aqueous solution and dispersed by an ultrasonic disperser for 30 sec.

(3) After left for 1 hr, the chained status of the sample staying on the bottom of the glass bottle is observed by a loupe at a magnification of 10 times.

Figure 3:
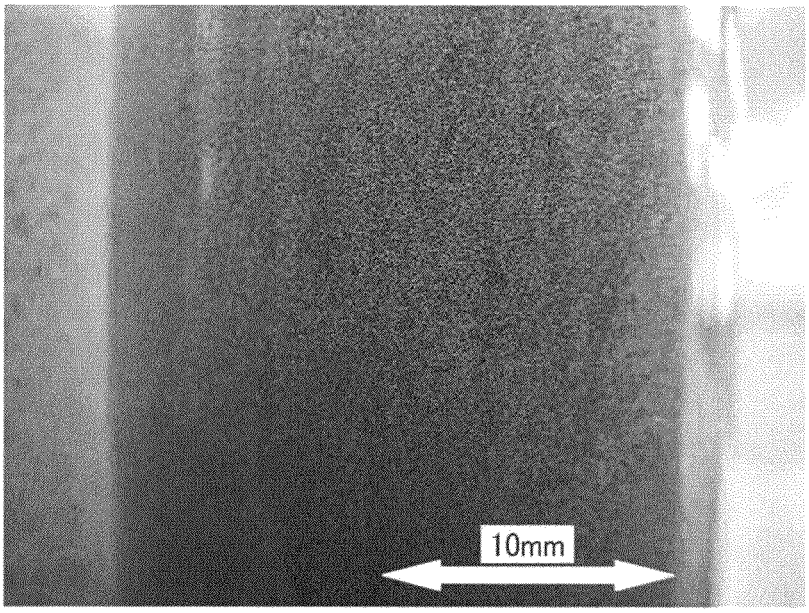
FIG. 3 is a photograph in which a particulate core material does not have magnetic aggregation in water a surfactant is added to in evaluation of the spontaneous magnetization of the present invention.
Figure 4:
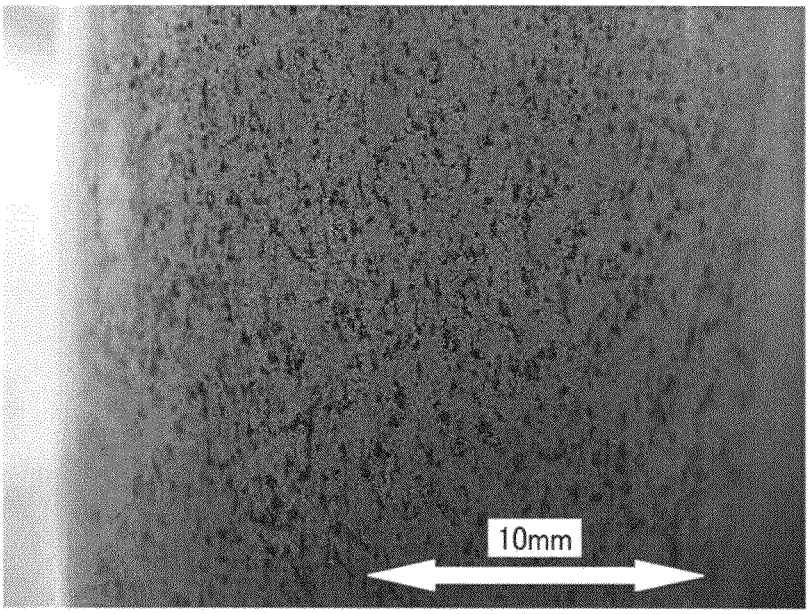
FIG. 4 is a photograph in which a particulate core material has magnetic aggregation in water a surfactant is added to in evaluation of the spontaneous magnetization of the present invention.

(4) Further, the glass bottle is turned upside down to fall the sample in the aqueous solution. Then, the sample is photographed to evaluate the aggregation thereof (Refer to FIGS. 3 and 4, and Table 1).

TABLE 1

| Chained status (3) (after left for 1 hr) | Magnetic aggregation (4) (photograph) | Spontaneous magnetization |
|---|---|---|
| None | None | Poor |
| Filiform | Slight | Good |
| Partially hairball-shaped | Medium | Very good |
| Wholly hairball-shaped | Considerable | Poor |

The above-mentioned evaluation method can be used for a carrier. In Table 1, when there is no spontaneous magnetization, the object is not solved. However, when the spontaneous magnetization is too large, the carrier and the developer aggregate so much the toner does not disperse well.

The carrier of the present invention preferably has a magnetization of from 40 to 65 [emu/g] in a magnetic field of 1 [kOe] (=about 79 [kA/m]). When less than 40 [emu/g], the carrier adherence worsens. When greater than 65 [emu/g], repulsive forces between the carriers in a horizontal direction of the sleeve, represented by the formula (I), becomes large and the magnetic brush decreases in area. Therefore, a toner noticeably contaminates the sleeve, resulting in worse ghost images.

The magnetic properties (magnetization $\sigma$ 1000 and a residual magnetization $\sigma r$) of the present invention are measured by a room-temperature exclusive high-sensitive vibrating sample magnetometer VSM-P7=15 type from Toei Industrial Co., Ltd., in which a sample is filled in a sample cell formed of an acrylic resin.

The carrier of the present invention is prepared by crushing or pulverizing a magnetic material, classifying the pulverized material to obtain a particulate core material having a predetermined particle diameter, and forming a resin coating thereon.

The spontaneous magnetization of the particulate core material of the present invention may be formed by outside magnetization. The magnetization is developed in a magnetic field less than 118.5 [kA/m] (1500[Oe]). Further, a fluidity of the particulate core material measured by the following method after magnetized needs to be slower by 3 to 12 sec than before magnetized.

According to fluidity test method JIS-Z2502, a time required for 50 g of particulate core material to flow out from an orifice of a funnel, having a diameter of 3.00 mm.

When less than 3 sec, the ghost image is not effectively prevented. When greater than 12 sec, the carrier or the developer magnetically aggregate so much that a toner fed to the carrier does not disperse well and scatters more.

When a burned particulate core material is magnetized from outside to have spontaneous magnetization, a fixed magnet, an electromagnetic belt or belt, or a developing sleeve including a magnet can locally (spontaneously) magnetize the surface of the magnetic core material.

When placed in an image developer, the carrier needs to have a fluidity measured by the following method after magnetized slower by 2 to 8 sec than before magnetized. The developer does as well.

According to fluidity test method JIS-Z2502, a time required for 50 g of particulate core material to flow out from an orifice of a funnel, having a diameter of 3.00 mm.

When less than 2 sec, the ghost image is not effectively prevented. When greater than 8 sec, the carrier or the developer magnetically aggregate so much that a toner fed to the carrier does not disperse well and scatters more.

The layer coated on the surface of the particulate core material is formed of compositions including an electroconductive material. As the electroconductive material, an electroconductive particulate material is preferably used. The electroconductive particulate material suitably adjusts a specific volume resistivity of the carrier. Specific examples thereof include carbon black, ITO, tin oxide, zinc oxide, etc., and these can be used alone or in combination. Indium oxide largely prevents the ghost images. An electroconductive particulate material formed of a substrate made of aluminum oxide and indium oxide doped with zinc coated on the substrate is preferably used.

Silicone resins mentioned later are preferably used as a resin for use in compositions for the coated layer. The carrier preferably includes the electroconductive particulate material in an amount of from 10 to 500% by weight based on total weight of the silicone resin. When less than 10% by weight, the specific volume resistivity of the carrier cannot effectively be adjusted. When greater than 500% by weight, the electroconductive particulate material is difficult to maintain, and the surface of the carrier is destructive.

Specific examples of the silicone resins include silicone resins including a repeat unit having the following formula (b):

(b)

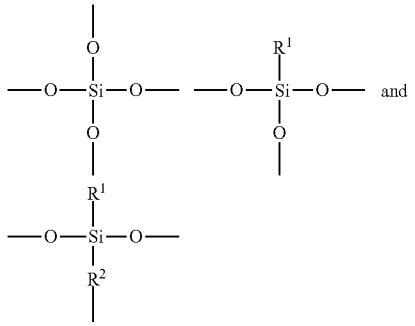

wherein $R^1$ represents a hydrogen atom, a hydroxy group, a methoxy group, a lower alkyl group having 1 to 4 carbon atoms or an aryl group such as a phenyl group and a tolyl group; $R^2$ represents an alkylene group having 1 to 4 carbon atoms or an arylene groups such as a phenylene group.

The aryl group in the formula (b) preferably has 6 to 20, and more preferably 6 to 14 carbon atoms. The aryl group includes aryl groups from condensed polycyclic aromatic hydrocarbons such as naphthalene, phenanthrene and anthracene; aryl groups from chained polycyclic aromatic hydrocarbons such as biphenyl and terphenyl; besides aryl (phenyl) groups from benzene. Various substituents may be bonded with the aryl group.

Straight silicone resins can be used as the silicone resins. Specific examples of marketed products of the straight silicones include, but are not limited to, KR271, KR272, KR282, KR252, KR255 and KR152 from Shin-Etsu Chemical Co., Ltd; and SR2400 and SR2406 from Dow Corning Toray Silicone Co., Ltd.

Modified silicone resins can be used as the silicone resins. Specific examples of the modified silicone resins include, but are not limited to, epoxy-modified silicone, acrylic-modified silicone, phenol-modified silicone, urethane-modified silicone, polyester-modified silicone and alkyd-modified silicone.

Specific examples marketed products of the modified silicones include, but are not limited to, EX1001N (epoxy-modified), KR5208 (acrylic-modified), KR206 (alkyd-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

Further, in the present invention, styrene resins such as polystyrene, chloropolystyrene, poly-α-methylstyrene, styrene-chlorostyrene copolymers, styrene-propylene copolymers; styrene-butadiene copolymers, styrene-vinylchloride copolymers, styrene-vinylacetate copolymers; styrene-maleic acid copolymers, styrene-esteracrylate copolymers (styrene-methylacrylate copolymers, styrene-ethylacrylate copolymers, styrene-butylacrylate copolymers, styrene-octylacrylate copolymers, styrene-phenylacrylate copolymers, etc.) and styrene-estermethacrylate copolymers (styrene-methylmethacrylate copolymers, styrene-ethylmethacrylate copolymers, styrene-butylmethacrylate copolymers, styrene-phenylmethacrylate copolymers, etc.); epoxy resins; polyester resins; polyethylene resins; polypropylene resins; ionomer resins; polyurethane resins; ketone resins; ethylene-ethylacrylate copolymers; xylene resins; polyamide resins; phenol resins; polycarbonate resins; melamine resins; etc. can be used alone or in combination with the silicone resins.

These resins and silicone resins are, although depending on the resin and compatibility thereof, typically mixed at a ratio (resins/silicone resin) of from 0/100 to 60/40, preferably from 0/100 to 50/50, and more preferably from 0/100 to 40/60. The straight silicone occasionally has poor compatibility, depending on its composition.

Specific examples of methods of forming a coated layer (resin layer formed of a composition including an electroconductive material) include known methods such as a spray dry method, a dip coating method and a fluidized-bed powder coating method. The coated layer (resin layer including an electroconductive material) typically has a thickness of from 0.02 to 3 μm, and preferably from 0.03 to 1.0 μm.

The carrier of the present invention and a toner form a developer.

The charge quantity (Q/M) of the developer, measured by the following method at 23° C. and 50% Rh, when the carrier is covered by the toner at a coverage of 50% is preferably from 10 to 70 μc/g, and more preferably from 15 to 50 μc/g.

Figure 5:
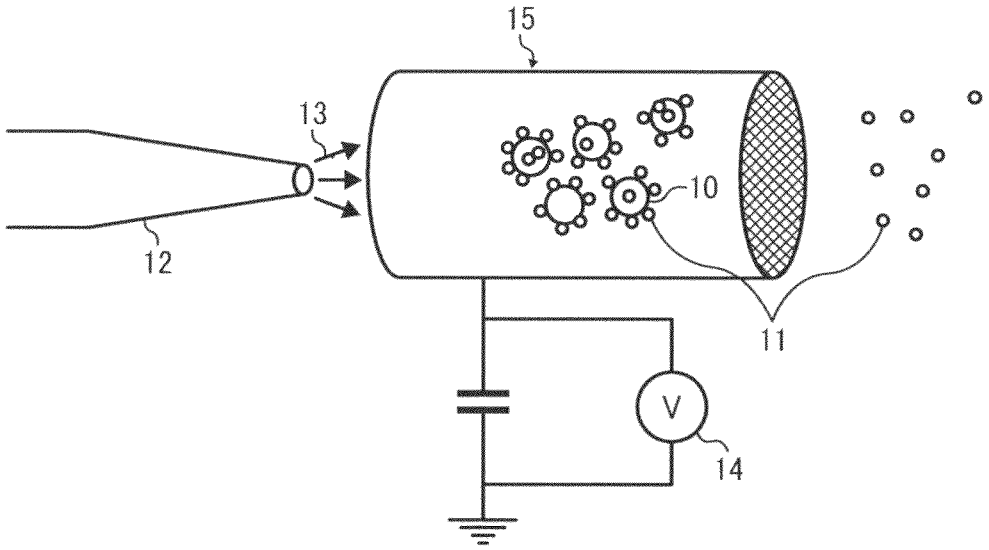
FIG. 5 is a skeleton framework of an apparatus used for measuring charge quantity of a developer in the present invention.

The charge quantity of the developer can be measured by the method in FIG. 5. Namely, a specific amount of the developer is placed in a blowoff cage 15 which is an electroconductive container having metallic meshes at both ends. The mesh has an opening of 20 μm which is a medium of the particle diameters of a toner 11 and a carrier 10 such that the toner can pass the mesh. From a nozzle 12, a compressed nitrogen gas 13 is sprayed [1 kgf/cm$^2$] for 60 sec to blow the toner out of the cage. The carrier having a polarity reverse to that of the toner remains in the cage. A numeral 14 is an electrometer.

The charge Q and the weight of the toner M are measured to determine the charge quantity Q/M [μc/g].

The coverage is determined by the following formula (IV):

$$\text{Coverage } (\%)=(W_t/W_c)\times(\rho_c/\rho_t)\times(D_c/D_t)\times(1/4)\times 100 \quad \text{(IV)}$$

wherein $D_c$ represents a weight-average particle diameter (μm) of the carrier; $D_t$ represents a weight-average particle diameter (μm) of the toner; $W_t$ represents a weight of the toner (g); $W_c$ represents a weight of the carrier (g); $\rho_t$ represents a true density (g/cm$^3$) of the toner; and $\rho_c$ represents a true density (g/cm$^3$) of the carrier.

The toner for used in the developer of the present invention may include a binder resin, a colorant, a charge controlling agent, etc. Known binder resins can be used as the binder resin. Specific examples of the binder resin include, but are not limited to, styrene and its derivative such as polystyrene, poly(p-styrene) and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleate copolymers; polymethylmethacrylate, polybutylmethacrylate, polyvinylchloride, polyvinyl acetate, polyethylene, polyester, polyurethane, epoxy resins, polyvinyl butyral, polyacrylic acid, rosin, modified rosin, terpene resins, phenolic resins, aliphatic or aromatic hydrocarbon resins, aromatic petroleum resins, etc. These can be used alone or in combination.

Known binder resins can be used as pressure-fixing binder resins. Specific examples of the binder resin include, but are not limited to, polyolefin such as low-molecular weight polyethylene and low-molecular weight polypropylene; olefin copolymers such as ethylene-acrylic acid copolymers, ethylene-acrylate copolymers, styrene-methacrylic acid copolymers, ethylene-methacrylate copolymers, ethylene-vinyl chloride copolymers, ethylene-vinyl acetate copolymers and ionomer resins; epoxy resins, polyester, styrene-butadiene copolymers, polyvinylpyrrolidone, methyl vinyl ether-anhydrous maleic acid copolymers, maleic acid-modified phenolic resins, phenol-modified terpene resins, etc.

The toner of the present invention may include a fixing aid besides the binder resin, a colorant and a charge controlling agent. This is why the toner can be used in an oilless system having a fixing system not applying an oil on a fixing roller such that a toner does not adhere thereto. Specific examples of the fixing aid include, but are not limited to, polyolefin such as polyethylene and polypropylene, fatty acid metal salt, fatty acid ester, paraffin wax, amide wax, polyhydric wax, silicone varnish, carnauba wax and ester wax etc.

Specific examples of the colorants include known pigments and dyes capable of forming yellow, magenta, cyan and black toners. Specific examples of yellow pigment include, but arc not limited to, cadmium yellow, mineral fast yellow, nickel titanium yellow, Naples yellow, naphthol yellow S, Hansa yellow G, Hansa yellow 10G, benzidine yellow GR, quinoline yellow lake, permanent yellow NCG and tartrazine lake.

Specific examples of orange pigments include, but are not limited to, molybdenum orange, permanent orange GTR, pyrazolone orange, Vulcan orange, indanthrene brilliant orange RK, benzidine orange G and indanthrene brilliant orange GK.

Specific examples of red pigments include, but are not limited to, iron red, cadmium red, permanent red 4R, lithol red, pyrazolone red, watching red calcium salt, lake red D, brilliant carmine 6B, eosin lake, rhodamine lake B, alizarin lake and brilliant carmine 3B.

Specific examples of violet pigments include, but are not limited to, fast violet B and methyl violet lake.

Specific examples of blue pigments include, but are not limited to, cobalt blue, alkali blue, Victoria blue lake, phthalocyanine blue, non-metal phthalocyanine blue, phthalocyanine blue-partly chloride, fast sky blue and indanthrene blue BC.

Specific examples of green pigments include, but are not limited to, chromium green, chromium oxide, pigment green B and malachite green lake.

Specific examples of black pigments include, but are not limited to, carbon black, oil furnace black, channel black, lamp black, acetylene black, an azine color such as aniline black, metal salt azo color, metal oxide, complex metal oxide.

These colorants can be used alone or in combination.

The toner may further include a charge controlling agent when necessary. The charge controlling agent is not particularly limited, and nigrosine; an azine dye having an alkyl group having 2 to 16 carbon atoms(see Japanese Examined Patent Publication No. 42-1627); a basic dye such as C.I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040) and C. I. Basic Green 4 (I. C. 42000); and a lake pigment of these basic dyes; a quaternary ammonium salt such as C. I. Solvent Black 8 (C. I. 26150), benzoylmethylhexadecylammonium chloride and decyltrimethyl chloride; a dialkyltin compound such as dibutyl and dioctyl; a dialkyltin borate compound; a guanidine derivative; a polyamine resin such as vinyl polymer having an amino group and condensation polymer having an amino group; a metal complex salt of monoazo dye described in Japanese Examined Patent Publication No. 41-20153, 43-27596, 44-6397 and 45-26478; salicylic acid described in Japanese Examined Patent Publication No. 55-42752 and 59-7385; a metal complex with Zn, Al, Co, Cr, Fe etc. of dialkylsalicylic acid, naphthoic acid and dicarboxylic acid; a sulfonated copper phthalocyanine pigment; organic boron acid slats; fluorine-containing quaternary ammonium salt; calixarene compound etc. can be used. For a color toner besides a black toner, a charge controlling agent impairing the original color should not be used, and white metallic salts of salicylic acid derivatives are preferably used.

Inorganic particulate materials such as silica, titanium oxide, alumina, silicon carbonate, silicon nitride and boron nitride; and particulate resins are externally added to mother toner particles to further improve transferability and durability thereof. This is because these external additives cover a release agent deteriorating the transferability and durability of a toner and the surface thereof to decrease contact area thereof.

The inorganic particulate materials are preferably hydrophobized, and hydrophobized particulate metal oxides such as silica and titanium oxide are preferably used. The particulate resins such as polymethylmethacrylate and polystyrene fine particles having an average particle diameter of from 0.05 to 1 μm, which are formed by a soap-free emulsifying polymerization method, are preferably used. Further, a toner including the hydrophobized silica and hydrophobized titanium oxide as external additives, in which an amount of the hydrophobized silica is larger than that of the hydrophobized titanium oxide, has good charge stability against humidity.

A toner including and external additives having a particle diameter larger than that of conventional external additives, such as a silica having a specific surface area of from 20 to 50 $m^2/g$ and particulate resins having an average particle diameter of from 1/100 to 1/8 to that of the toner besides the inorganic particulate materials, has good durability. This is because the external additives having a particle diameter larger than that of the particulate metal oxides prevent the particulate metal oxides from being buried in mother toner particles, although tending to be buried therein while the toner is mixed and stirred with a carrier, and charged in an image developer for development.

A toner internally including the inorganic particulate materials and particulate resins improves pulverizability as well as transferability and durability although improving less than a toner externally including them. When the external and internal additives are used together, the burial of the external additives in mother toner particles can be prevented and the resultant toner stably has good transferability and durability.

Specific examples of the hydrophobizer include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxylsilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminium coupling agents can be used. Besides, as an external additive for the purpose of improving cleanability, lubricants such as a particulate fatty acid metal salt and polyvinylidene fluoride can be used.

The toner of the present invention can be prepared by known methods such as a pulverization method and a polymerization method. In the pulverization method, as apparatuses for melting and kneading a toner, a batch type two-roll kneading machine, a Bumbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG are preferably used.

The melted and kneaded materials thereby are cooled and pulverized. A hammer mill, rotoplex, etc. crush the cooled materials, and jet stream and mechanical pulverizers pulverize the crushed materials to preferably have an average particle diameter of from 3 to 15 μm. Further, the pulverized materials are classified into the materials having particle diameters of from 5 to 20 μm by a wind-force classifier, etc.

Next, an external additive is preferably added to mother toner particles. The external additive and mother toner particles are mixed and stirred by a mixer such that the external additive covers the surface of the mother toner particles while pulverized. It is essential that the external additives such as inorganic particulate materials and particulate resins are uniformly and firmly fixed to the mother toner particles improve durability of the resultant toner. This is simply an example and the method is not limited thereto.

A volume-average particle diameter (Dv) and a number-average particle diameter (Dn) of the toner are measured by Multisizer III from Beckman Coulter, Inc. with an aperture diameter of 100 μm. An analysis software (Beckman Coulter Multisizer 3 version 3.51) was used. Specifically, 0.1 to 0.5 g of the toner and 0.5 ml of a surfactant (alkylbenzenesulfonate Neogen SC-A from Dai-ichi Kogyo Seiyaku Co., Ltd.) having a concentration of 10% by weight were mixed by a micro spatel in a glass beaker having a capacity of 100 ml, and 80 ml of ion-exchange water was added to the mixture. The mixture was dispersed by an ultrasonic disperser W-113MK-II from HONDA ELECTRONICS CO., LTD. for 10 min. The dispersion was measure by Multisizer III using ISOTON III as a measurement solution from Beckman Coulter, Inc. The dispersion was dropped such that Multisizer III displays a concentration of 8±2%, which is essential in terms of measurement reproducibility of the particle diameter. The measurement of the particle diameter has no error within this concentration range. A weight-average particle diameter (Dw) can be determined from the volume distribution and the number distribution measured by the above-mentioned measurer.

The process cartridge of the present invention includes at least an electrostatic latent image bearer and an image developer developing an electrostatic latent image formed on the electrostatic latent image bearer with the developer of the present invention in a body, which is detachable from an image forming apparatus.

Figure 6:
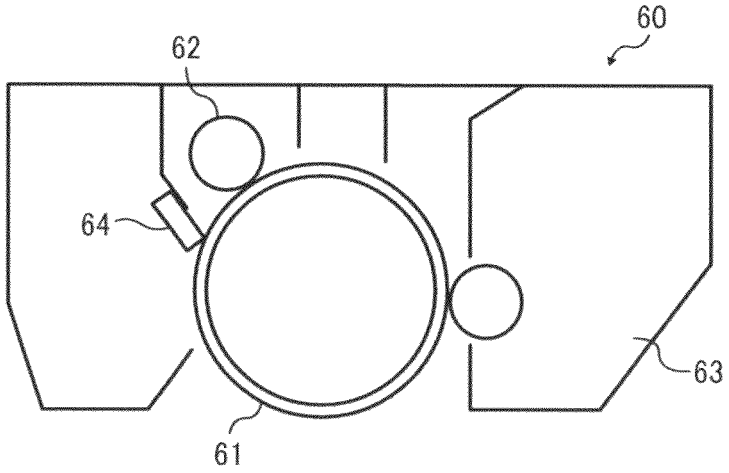
FIG. 6 is a schematic view illustrating an embodiment of the process cartridge of the present invention.

FIG. 6 is a schematic view illustrating an embodiment of the process cartridge of the present invention. In FIG. 6, a process cartridge 60 includes main components of an image forming apparatus such as a photoreceptor 61, a charger 62, an image developer 63 using the developer of the present invention and a cleaner 64.

Namely, in the present invention, among the photoreceptor, the charger, the image developer and the cleaner, the image developer using the developer of the present invention and other single or plural means are combined in a body as a process cartridge detachable from image forming apparatuses such as copiers and printers.

In an image forming apparatus having the process cartridge of the present invention, including an image developer, a photoreceptor rotates at a predetermined peripheral speed. The circumferential surface of the photoreceptor is positively or negatively charged evenly by a charger in the process of rotating. Next, the circumferential surface is irradiated by an irradiator such as slit irradiators and laser beam scanning irradiators with imagewise light to from an electrostatic latent image thereon. The electrostatic latent image is developed by an image developer with a toner to form a toner image. The toner image is transferred by a transferer onto a transfer material synchronously fed between the photoreceptor and the transferer. The transfer material having received the toner image separates from the photoreceptor and comes into a fixer where the toner image is fixed thereon, and the transfer material the toner image is fixed on is printed out as a copy. The surface of the photoreceptor is cleaned by a cleaner removing the toner remaining untransferred thereon, and further discharged to be ready to form a following image.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Toner Preparation Example

[Toner 1]

(Synthesis of Toner Binder)

Seven twenty four (724) parts of an adduct of bisphenol A with 2 moles of ethyleneoxide, 276 parts isophthalic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 32 parts of phthalic acid anhydride were added thereto and reacted for 2 hrs at 160° C. Next, the mixture was reacted with 188 parts of isophoronediisocyanate in ethyl acetate for 2 hrs at 80° C. to prepare a prepolymer including isocyanate (1). Next, 267 parts of the prepolymer (1) and 14 parts of isophoronediamine were mixed for 2 hrs at 50° C. to prepare a urea-modified polyester resin (1) having a weigh-average molecular weight of 64,000. Similarly, 724 parts of an adduct of bisphenol A with 2 moles of ethyleneoxide and 276 parts of terephthalic acid were polycondensed for 8 hrs at a normal pressure and 230° C., and further, after the mixture was depressurized by 10 to 15 mm Hg and reacted for 5 hrs to prepare a unmodified polyester resin (a) having a peak molecular weight of 5,000. Two hundred (200) parts of the urea-modified polyester (1) and 800 parts of the unmodified polyester resin (a) were dissolved and mixed in 2,000 parts of a mixed solvent formed of ethyl acetate and MEK (1/1) to prepare a toner binder (1) ethyl acetate/MEK solution. The toner binder resin (1) ethyl acetate/MEK solution was partially depressurized and dried to isolate the toner binder (1). The toner binder (1) had a glass transition temperature (Tg) of 62° C.

(Preparation of Toner)

Two forty (240) parts of the toner binder (1) ethyl acetate/MEK solution, 20 parts of pentaerythritoltetrabehenate having a melting point of 81° C. and a melting viscosity of 25 cps and 4 parts of C.I. Pigment Yellow 154 were uniformly dissolved and dispersed with TK-HOMOMIXER at 12,000 rpm and 60° C. in a beaker to prepare a toner constituents solution. Seven hundred and six (706) parts of ion-exchanged water, 294 parts of hydroxyapatite suspension liquid having a concentration of 10% (Supertite 10 from Nippon Chemical Industrial Co., Ltd.) and 0.2 parts of sodium dodecylbenzenesulfonate were uniformly dissolved in a beaker to prepare a solution. The solution was heated to have a temperature of 60° C. and the toner constituents liquid was put therein while stirred with TK-HOMOMIXER at 12,000 rpm for 10 min to prepare a liquid mixture. The liquid mixture was placed in a flask having a stirrer and a thermometer and heated to have a temperature of 98° C., and a solvent was removed therefrom to prepare a dispersion slurry. The dispersion slurry was depressurized and filtered to prepare a filtered cake.

1: 100 parts of ion-exchanged water were added to the filtered cake, which was mixed with TK-HOMOMIXER at 12,000 rpm for 10 min and filtered.

2: 100 parts of sodium hydroxide solution having a concentration of 10% were added to the filtered cake of 1, which was mixed with TK-HOMOMIXER at 12,000 rpm for 30 min and filtered under reduced pressure.

3: 100 parts of hydrochloric acid having a concentration of 10% were added to the filtered cake of 2, which was mixed with TK-HOMOMIXER at 12,000 rpm for 30 min and filtered.

4: 300 parts of ion-exchanged water were added to the filtered cake of 3, which was mixed with TK-HOMOMIXER at 12,000 rpm for 10 min and filtered twice to prepare a [filtered cake 1].

5: The [filtered cake 1] was dried by an air drier at 45° C. for 48 hrs. 6: 15 parts of the [filtered cake 1] were added to 90 parts of water, in which 0.0005 parts of a fluorine compound were dispersed so as to adhere to the surface of toner particles. Next, the toner particles the fluorine compound adhered on were dried by an air drier at 45° C. for 48 hrs.

7: Then, the toner particles were sieved with a mesh having an opening of 75 to prepare [mother toner particles 1].

As external additives, 1.5 parts of hydrophobic silica and 0.7 parts of hydrophobized titanium oxide were mixed with 100 parts of the [mother toner particles 1] by HENSCHEL MIXER at 2,000 rpm for 30 sec 5 times to prepare a cyan toner. This is a [toner 1].

Core Material Preparation Example

Core Material Preparation Example 1

$MnCO_3$, $Mg(OH)_2$, $Fe_2O_3$, $SiO_2$ and $P_2O_5$ powders were weighed and mixed to prepare a mixed powder. The mixed powder was fired in a heating furnace at 900° C. for 3 hr in the atmosphere, and the burned powder was cooled and pulverized to prepare a powder having a particle diameter about 7 μm. A dispersant in an amount of 1% by weight was added to the powder together with water to prepare a slurry, and the slurry was granulated by a spray drier to prepare a granulated material having an average particle diameter about 40 μm. The granulated material was placed in a firing furnace and fired at 1,250° C. for 5 hrs in a nitrogen atmosphere. The fired material was pulverized by a pulverizer and sieved to a MnMg ferrite particulate core material (1) [core material (1)] having a weight-average particle diameter about 41.2 μm. The core material (1) included MnO, MgO, $Fe_2O_3$, $SiO_2$ and $P_2O_5$ in amounts of 45.2%, 1.24%, 49.25%, 1.81% and 2.09% by mol, respectively. The main component was Mn ferrite.

Properties of the core material (1) such as particle diameter, development of spontaneous magnetization, fluidity and magnetic properties, and main components and additives thereof are shown in Tables 2-1 and 2-2.

Core Material Preparation Example 2

The procedure for preparation of the core material (1) in Core Material Preparation Example 1 was repeated to prepare a core material (2) except for not having weighed and mixed the $P_2O_5$ powder.

Properties of the core material (2) such as particle diameter, development of spontaneous magnetization, fluidity and magnetic properties, and main components and additives thereof are shown in Tables 2-1 and 2-2.

Core Material Preparation Example 3

The procedure for preparation of the core material (1) in Core Material Preparation Example 1 was repeated to prepare a core material (3) except that the slurry was granulated by a spray drier to prepare a granulated material having an average particle diameter about 46 μm.

Properties of the core material (3) such as particle diameter, development of spontaneous magnetization, fluidity and magnetic properties, and main components and additives thereof are shown in Tables 2-1 and 2-2.

Core Material Preparation Example 4

The procedure for preparation of the core material (1) in Core Material Preparation Example 1 was repeated to prepare a core material (4) except that the slurry was granulated by a spray drier to prepare a granulated material having an average particle diameter about 28 μm.

Properties of the core material (4) such as particle diameter, development of spontaneous magnetization, fluidity and magnetic properties, and main components and additives thereof are shown in Tables 2-1 and 2-2.

Core Material Preparation Example 5

The core material (1) was placed in an image developer modified to replace its main pole with a magnet having 23.7 [kA/m] (300 [Oe]) of Imagio Neo 600 from Ricoh Company, Ltd., and its developing sleeve was rotated for 30 min to largely develop a spontaneous magnetization of the core material to prepare a core material (5). Properties of the core material (5) such as particle diameter, development of spontaneous magnetization, fluidity and magnetic properties, and main components and additives thereof are shown in Tables 2-1 and 2-2.

The core material (5) had a fluidity of 30.8 sec before treated and 39.5 sec after treated.

The fluidity was measured by the above-mentioned method according to JIS-Z2502.

Core Material Preparation Example 6

$MnCO_3$, $Mg(OH)_2$, $Fe_2O_3$ and $SrCO_3$ powders were weighed and mixed to prepare a mixed powder.

The mixed powder was fired in a heating furnace at 1200° C. for 1 hr in the atmosphere, and the burned powder was cooled and pulverized to prepare a powder having a particle diameter not greater than 3 μm. A dispersant in an amount of 1% by weight was added to the powder together with water to prepare a slurry, and the slurry was granulated by a spray drier to prepare a granulated material having an average particle diameter about 40 μm. The granulated material was placed in a firing furnace and fired at 1,275° C. for 4 hrs in a nitrogen atmosphere. The fired material was pulverized by a pulverizer and sieved to a MnMgSr ferrite core material (6) having a weight-average particle diameter about 35 μm. The core material (6) included MnO, MgO, $Fe_2O_3$ and SrO in amounts of 40.0%, 10.0%, 50% and 0.4% by mol, respectively. The main component was MnMgSr ferrite.

Figure 7:
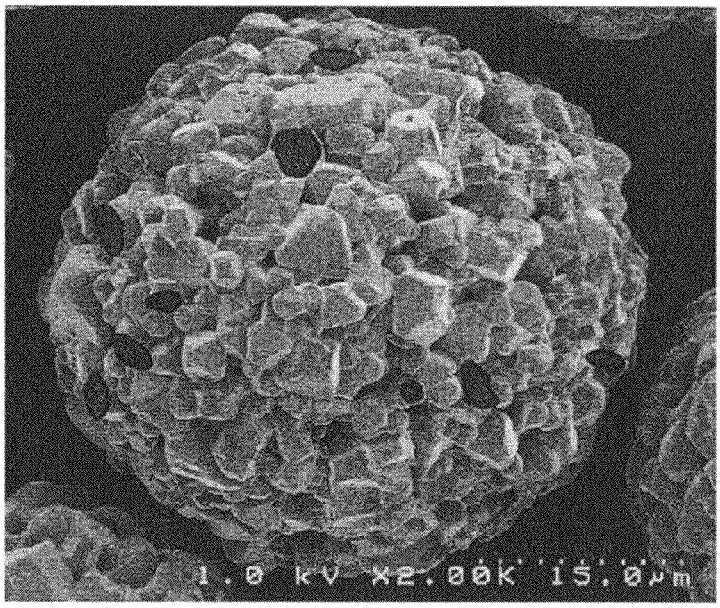
FIG. 7 is an electron microscopic picture showing a particulate core material on which a single layer of magnetoplumbite ferrite is partially formed.

The core material (6) develops a spontaneous magnetization well. When observed by an electron microscope, crystalline forms having shape of a hexagonal plate are formed in many places as FIG. 7 shows (marked in black), i.e., a single phase of magnetoplumbite ferrite is partially formed on the surface of the core material. Properties of the core material (6) such as particle diameter, development of spontaneous magnetization, fluidity and magnetic properties, and main components and additives thereof are shown in Tables 2-1 and 2-2.

Core Material Preparation Example 7

$MnCO_3$, $Mg(OH)_2$, $Fe_2O_3$ and $CaCO_3$ powders were weighed and mixed to prepare a mixed powder. The mixed powder was fired in a heating furnace at 950° C. for 1 hr in the atmosphere, and the burned powder was cooled and pulverized to prepare a powder having a particle diameter not greater than 3 μm. A dispersant in an amount of 1% by weight was added to the powder together with water to prepare a slurry, and the slurry was granulated by a spray drier to prepare a granulated material having an average particle diameter about 40 μm. The granulated material was placed in a firing furnace and fired at 1,250° C. for 5 hrs in a nitrogen atmosphere. The fired material was pulverized by a pulverizer and sieved to a MnMgCa ferrite core material (7) having a weight-average particle diameter about 35 μm. [A single phase of calcium ferrite is partially formed on the surface of the core material.] The core material (7) included MnO, MgO, $Fe_2O_3$ and CaO in amounts of 44.3%, 0.7%, 53% and 2.0% by mol, respectively. The main component was calcium ferrite.

Properties of the core material (7) such as particle diameter, development of spontaneous magnetization, fluidity and magnetic properties, and main components and additives thereof are shown in Tables 2-1 and 2-2.

TABLE 2-1

| | Particle Diameter | | Magnetic aggregation | |
|---|---|---|---|---|
| | Dw (μm) | Dw/Dp | Before magnetized | After magnetized |
| Core material (1) | 41.2 | 1.26 | Good | — |
| Core material (2) | 41.0 | 1.25 | Poor | — |
| Core material (3) | 48.0 | 1.28 | Poor | — |
| Core material (4) | 23.4 | 1.20 | Poor | — |
| Core material (5) | 31.2 | 1.21 | Good | Very good |
| Core material (6) | 31.0 | 1.23 | Very good | — |
| Core material (7) | 31.0 | 1.24 | Very good | — |

TABLE 2-2

| | Fluidity | | Magnetic Properties | | Magnetic Material | |
|---|---|---|---|---|---|---|
| | Before magnetized | After magnetized | σ1000 (emu/g) | Br (emu/g) | Main component | Main additive |
| Core material (1) | 30.8 | — | 64 | 0.9 | Mn ferrite | P |
| Core material (2) | 25.1 | — | 66 | 0.7 | Mn ferrite | None |
| Core material (3) | 24.8 | — | 64 | 0.8 | Mn ferrite | P |
| Core material (4) | 36.3 | — | 64 | 0.8 | Mn ferrite | P |
| Core material (5) | 30.8 | 39.5 | 64 | 0.9 | Mn ferrite | P |
| Core material (6) | 38.5 | — | 61 | 0.8 | MnMgSr | None |
| Core material (7) | 39.1 | — | 60 | 0.7 | Ca ferrite | None |

Carrier Preparation Example

Carrier Preparation Example 1

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Methacrylic copolymer 1 (including a solid content of 100% by weight) | 18.0 |
| Silicone resin solution (SR2410 including a solid content of 20% by weight from Dow Corning Toray Silicone Co., Ltd.) | 360.0 |
| Aminosilane (SH6020 including a solid content of 100% by weight from Dow Corning Toray Silicone Co., Ltd.) | 4.0 |
| EC-700 (from Titan Kogyo Co., Ltd., having a particle diameter of 0.35 μm) | 200 |
| Toluene | 900 |

On 5,000 parts by weight of the core material (1), a solution including the resin-coated layer forming solution and an additional 10.5 parts of titanium diisopropoxybis(ethylacetoacetate) (TC-750 from Matsumoto Fine Chemical Co., Ltd.) was coated by SPIRA COTA (from Okada Seiko Co., Ltd.) at a an inner temperature of 70° C. and dried. The coated core material (1) was burned in an electric oven at 210° C. for 1 hr. After cooled, the ferrite powder bulk was sieved through openings of 63 μm to prepare a carrier A.

Properties of the carrier A such as a particle diameter, electrical resistivity, magnetic properties, development of spontaneous magnetization and fluidity, and the core material used are shown in Tables 3-1 to 3-3.

Carrier Preparation Example 2

The procedure for preparation of the carrier A in Carrier preparation Example 1 was repeated to prepare a carrier B except for replacing the core material (1) with the core material (2).

Properties of the carrier B such as a particle diameter, electrical resistivity, magnetic properties, development of spontaneous magnetization and fluidity, and the core material used are shown in Tables 3-1 to 3-3.

Carrier Preparation Example 3

The procedure for preparation of the carrier A in Carrier preparation Example 1 was repeated to prepare a carrier C except for changing the parts by weight of EC-700 (from Titan Kogyo Co., Ltd., having a particle diameter of 0.35 μm) from 200 to 550.

Properties of the carrier C such as a particle diameter, electrical resistivity, magnetic properties, development of spontaneous magnetization and fluidity, and the core material used are shown in Tables 3-1 to 3-3.

Carrier Preparation Example 4

The procedure for preparation of the carrier A in Carrier preparation Example 1 was repeated to prepare a carrier D except for changing the parts by weight of EC-700 (from Titan Kogyo Co., Ltd., having a particle diameter of 0.35 μm) from 200 to 110.

Properties of the carrier D such as a particle diameter, electrical resistivity, magnetic properties, development of spontaneous magnetization and fluidity, and the core material used are shown in Tables 3-1 to 3-3.

Carrier Preparation Example 5

The procedure for preparation of the carrier A in Carrier preparation Example 1 was repeated to prepare a carrier E except for replacing the core material (1) with the core material (3).

Properties of the carrier E such as a particle diameter, electrical resistivity, magnetic properties, development of spontaneous magnetization and fluidity, and the core material used are shown in Tables 3-1 to 3-3.

Carrier Preparation Example 6

The procedure for preparation of the carrier A in Carrier preparation Example 1 was repeated to prepare a carrier F except for replacing the core material (1) with the core material (4).

Properties of the carrier F such as a particle diameter, electrical resistivity, magnetic properties, development of spontaneous magnetization and fluidity, and the core material used are shown in Tables 3-1 to 3-3.

Carrier Preparation Example 8

The procedure for preparation of the carrier A in Carrier preparation Example 1 was repeated to prepare a carrier H except for replacing the core material (1) with the core material (5).

Properties of the carrier H such as a particle diameter, electrical resistivity, magnetic properties, development of spontaneous magnetization and fluidity, and the core material used are shown in Tables 3-1 to 3-3.

Carrier Preparation Example 9

The carrier A was placed in an image developer modified to replace its main pole with a magnet having 23.7 [kA/m] (300 [Oe]) of Imagio Neo 600 from Ricoh Company, Ltd., and its developing sleeve was rotated for 30 min to largely develop a spontaneous magnetization of the carrier to prepare a carrier I.

The carrier I had a fluidity of 23.2 sec before treated and 28.3 sec after treated. The fluidity was measured by the above-mentioned method according to JIS-Z2502.

Properties of the carrier I such as particle diameter, development of spontaneous magnetization, fluidity and magnetic properties, and main components and additives thereof are shown in Tables 3-1 to 3-3.

Carrier Preparation Example 10

The procedure for preparation of the carrier A in Carrier preparation Example 1 was repeated to prepare a carrier J except for replacing the core material (1) with the core material (6).

Properties of the carrier J such as a particle diameter, electrical resistivity, magnetic properties, development of spontaneous magnetization and fluidity, and the core material used are shown in Tables 3-1 to 3-3.

Carrier Preparation Example 11

The procedure for preparation of the carrier A in Carrier preparation Example 1 was repeated to prepare a carrier K except for replacing the core material (1) with the core material (7).

Properties of the carrier K such as a particle diameter, electrical resistivity, magnetic properties, development of spontaneous magnetization and fluidity, and the core material used are shown in Tables 3-1 to 3-3.

TABLE 3-1

| | | Particle Diameter | | Electrical resistivity |
|---|---|---|---|---|
| | | Dw (μm) | Dw/Dp | LogR (Ωcm) |
| Carrier A | Core material (1) | 41.8 | 1.25 | 10.3 |
| Carrier B | Core material (2) | 41.6 | 1.24 | 10.3 |
| Carrier C | Core material (1) | 42.2 | 1.27 | 7.3 |
| Carrier D | Core material (1) | 41.7 | 1.25 | 12.8 |
| Carrier E | Core material (3) | 48.8 | 1.27 | 10.1 |
| Carrier F | Core material (4) | 23.9 | 1.19 | 10.4 |
| Carrier H | Core material (5) | 31.7 | 1.22 | 10.2 |
| Carrier I | Core material (1) | 42.0 | 1.26 | 10.3 |
| Carrier J | Core material (6) | 31.6 | 1.24 | 10.3 |
| Carrier K | Core material (7) | 31.6 | 1.23 | 10.1 |

TABLE 3-2

| | | Magnetic Properties | | Magnetic aggregation | |
|---|---|---|---|---|---|
| | | σ1000 (emu/g) | Br (emu/g) | Before magnetized | After magnetized |
| Carrier A | Core material (1) | 62 | 0.8 | Good | — |
| Carrier B | Core material (2) | 63 | 0.6 | Poor | — |
| Carrier C | Core material (1) | 58 | 0.8 | Good | — |
| Carrier D | Core material (1) | 63 | 0.9 | Good | — |
| Carrier E | Core material (3) | 62 | 0.8 | Poor | — |
| Carrier F | Core material (4) | 61 | 0.8 | Poor | — |
| Carrier H | Core material (5) | 61 | 0.7 | Good | Very good |
| Carrier I | Core material (1) | 62 | 0.9 | Good | Very good |
| Carrier J | Core material (6) | 58 | 0.8 | Very good | — |
| Carrier K | Core material (7) | 57 | 1 | Very good | — |

TABLE 3-3

| | | Fluidity | | Electroconductive material | |
|---|---|---|---|---|---|
| | | Before magnetized | After magnetized | Name | Parts by weight |
| Carrier A | Core material (1) | 23.2 | — | EC700 | 200 |
| Carrier B | Core material (2) | 17.0 | — | EC700 | 200 |
| Carrier C | Core material (1) | 21.0 | — | EC700 | 550 |

TABLE 3-3-continued

| | | Fluidity | | Electroconductive material | |
|---|---|---|---|---|---|
| | | Before magnetized | After magnetized | Name | Parts by weight |
| Carrier D | Core material (1) | 24.9 | — | EC700 | 110 |
| Carrier E | Core material (3) | 16.1 | — | EC700 | 200 |
| Carrier F | Core material (4) | 29.8 | — | EC700 | 200 |
| Carrier H | Core material (5) | 23.2 | 27.9 | EC700 | 200 |
| Carrier I | Core material (1) | 23.2 | 28.3 | EC700 | 200 |
| Carrier J | Core material (6) | 27.8 | — | EC700 | 200 |
| Carrier K | Core material (7) | 28.1 | — | EC700 | 200 |

Examples 1 to 5 and Comparative Examples 1 to 5

Seven (7) parts of the [toner 1] and 93 parts of each of the carriers A to F and H to K were mixed and stirred to prepare 10 developers.

Each of the 10 developers was set in a digital full-color printer RICOH Pro C901 from Ricoh Company, Ltd. to evaluate the qualities of the initial image and the image after 100K images were produced. The evaluation results are shown in Tables 4-1 and 4-2.

TABLE 4-1

| | | Initial | | | | | | |
|---|---|---|---|---|---|---|---|---|
| | | TCQ | ID | BF | GI | CAI | CAB | TS |
| Example 1 | Carrier A | 35 | 1.63 | Good | Fair | Good | Good | Good |
| Comparative Example 1 | Carrier B | 34 | 1.62 | Good | Poor | Good | Good | Good |
| Comparative Example 2 | Carrier C | 28 | 1.67 | Good | Poor | Poor | Good | Good |
| Comparative Example 3 | Carrier D | 36 | 1.61 | Good | Poor | Good | Good | Good |
| Comparative Example 4 | Carrier E | 32 | 1.65 | Good | Poor | Good | Good | Good |
| Comparative Example 5 | Carrier F | 43 | 1.57 | Good | Poor | Poor | Poor | Good |
| Example 2 | Carrier H | 37 | 1.61 | Good | Good | Good | Good | Good |
| Example 3 | Carrier I | 36 | 1.62 | Good | Very good | Good | Good | Good |
| Example 4 | Carrier J | 38 | 1.60 | Good | Very good | Good | Good | Good |
| Example 5 | Carrier K | 39 | 1.61 | Good | Very good | Good | Good | Good |

TABLE 4-2

| | | After 100K | | | | | | |
|---|---|---|---|---|---|---|---|---|
| | | TCQ | ID | BF | GI | CAI | CAB | TS |
| Example 1 | Carrier A | 33 | 1.64 | Good | Good | Good | Good | Good |
| Comparative Example 1 | Carrier B | 31 | 1.65 | Good | Poor | Good | Good | Poor |

TABLE 4-2-continued

| | | After 100K | | | | | | |
|---|---|---|---|---|---|---|---|---|
| | | TCQ | ID | BF | GI | CAI | CAB | TS |
| Comparative Example 2 | Carrier C | 19 | 1.70 | Poor | Poor | Poor | Good | Poor |
| Comparative Example 3 | Carrier D | 32 | 1.65 | Good | Poor | Good | Good | Good |
| Comparative Example 4 | Carrier E | 28 | 1.67 | Poor | Poor | Good | Good | Poor |
| Comparative Example 5 | Carrier F | 27 | 1.68 | Poor | Poor | Poor | Poor | Poor |
| Example 2 | Carrier H | 37 | 1.62 | Good | Very good | Good | Good | Good |
| Example 3 | Carrier I | 34 | 1.64 | Good | Very good | Good | Good | Good |
| Example 4 | Carrier J | 37 | 1.62 | Good | Very good | Good | Good | Good |
| Example 5 | Carrier K | 35 | 1.63 | Good | Very good | Good | Good | Good |

TCQ: toner charge quantity (μc/g)
BF: background fouling
GI: ghost image
CAI: carrier adherence on solid image
CAB: carrier adherence on background
TS: toner scattering Test methods and evaluation standards in Tables 4-1 and 4-2 are as follows.

The image quality on a transfer paper was evaluated. Carrier adherence was observed after development and before transfer by collecting the carrier from the surface of the photoreceptor with an adhesive tape.

(1) Solid image density (ID): An average of five points of the center of a solid image having an area of 30 mm×30 mm measured by a densitometer X-Rite 938.

(2) Background fouling: Visually observed.

Figure 8:
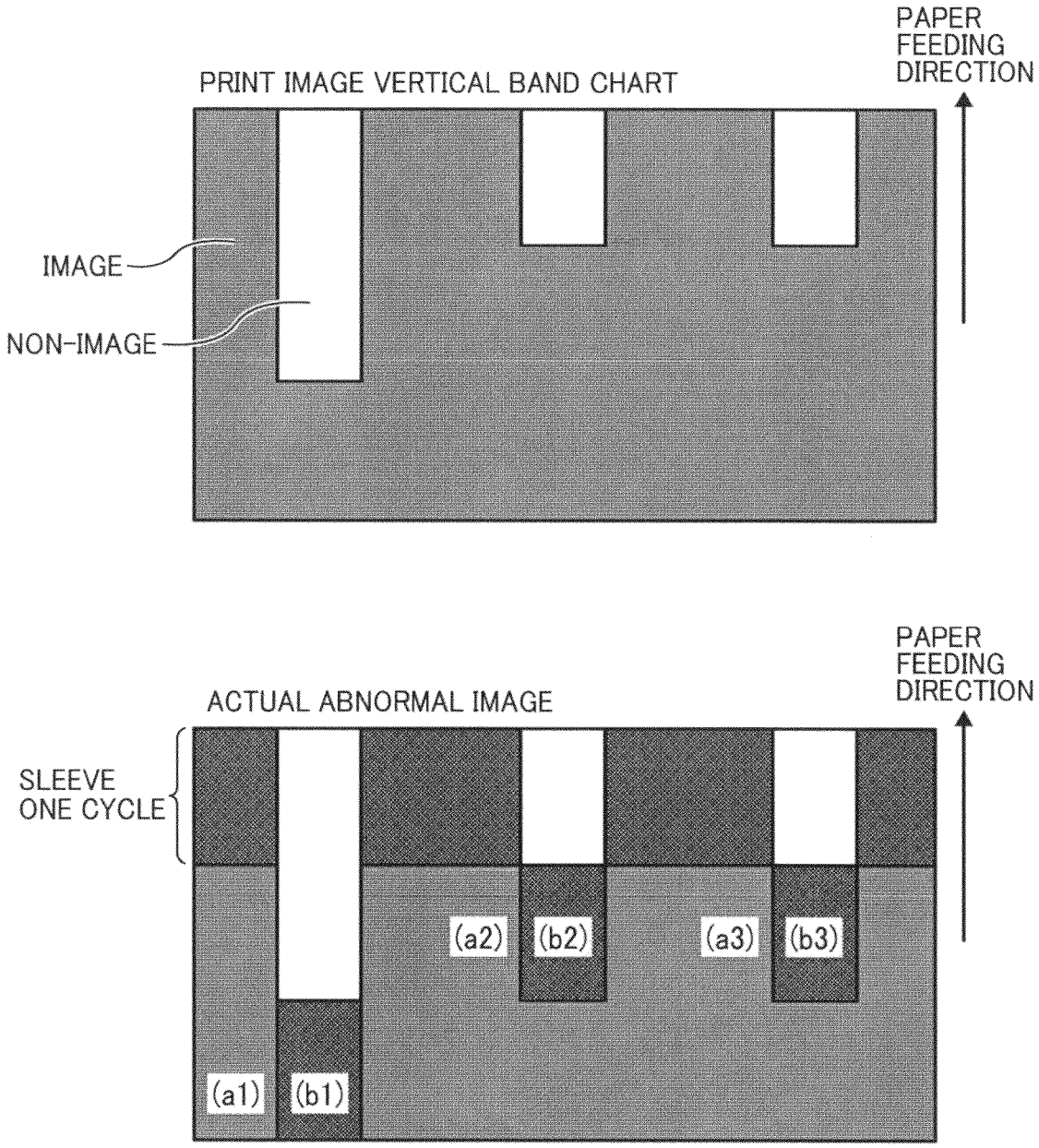
FIG. 8 is a printed vertical band chart and a schematic view for explaining abnormal images in evaluation of ghost images.

(3) Each of the developers was set in a marketed digital full-color printer RICOH Pro C901 from Ricoh Company, Ltd. After 100,000 images of a letter chart (2 mm×2 mm/letter) having an image area ratio of 8% were produced, a vertical band chart in FIG. 8 was printed to measure a difference of density between one cycle (a) and after one cycle (b) of sleeve and by X-Rite 938 from X-Rite, Inc. An average density among the center, rear and front was AID.

Very good: $0.01 \geq \Delta ID$

Good: $0.01 < \Delta ID \leq 0.03$

Acceptable: $0.03 < \Delta ID \leq 0.06$

Unusable: $0.06 < \Delta ID$ (4) Carrier adherence (on solid mage): After a solid image having an area of 30 mm×30 mm was developed, the carrier on the photoreceptor was counted. "Good" means "one or less", and "Poor" means two or more.

(5) Carrier adherence (on background): A two dot line image developed on the photoreceptor was transferred onto an adhesive tape having an area of 100 $cm^2$, and the carrier on thereon was counted. "Good" means "one or less", and "Poor" means two or more.

(6) Toner scattering: observed around the image developer after 100 k images were produced. "Good" means "acceptable", and "Poor" means "too much".

All of the developers of Examples 1 to 5 using the carrier A and carriers H to K having an electrical resistivity Log R [CΩcm] of from 8.0 to 12.0 and a weight-average particle diameter (Dw) of from 25 to 45 μm had good results of the solid image density, background fouling, ghost image, carrier adherence (on solid image and background) and toner scattering for both of the initial image and the image after 100K images were produced. Particularly, the Mn ferrite core materials (1) and (5) having improved spontaneous magnetization and the MnMgSr ferrite core material (6) and the calcium ferrite core material (7) had very good results.

All of the carries B, E and F using the core material developing no spontaneous magnetization, the carriers C and D not having an electrical resistivity Log R [Ωcm] of from 8.0 to 12.0, and the carriers E and F not having a weight-average particle diameter (Dw) of from 25 to 45 μm cause ghost images unacceptable in practical use. After 100 k images were produced, the carriers C and D and the carrier E worsened in at least one of background fouling, ghost image, carrier adherence (on solid image and background) and toner scattering. The carrier F worsened in all of the properties.

Having now fully described the invention, it will be apparent to one of ordinary skill in the art that many changes and modifications can be made thereto without departing from the spirit and scope of the invention as set forth therein.

What is claimed is:

1. A carrier for developing an electrostatic latent image, comprising:

a particulate core material having a magnetism having developed spontaneous magnetization; and a covering layer comprising an electroconductive material, covering the surface of the particulate core material, wherein a single phase of a magnetoplumbite ferrite or a calcium ferrite is partially formed on the surface of the particulate core material, wherein the carrier has an electrical resistivity Log R [Ωcm] of from 8.0 to 12.0 when measured by a method, comprising:

filling the carrier in a cell containing a pair of facing electrodes, each having a surface area of 2×4 [$cm^2$] with a gap of 2 [mm] therebetween; and applying a DC voltage of 1,000 [V] therebetween to measure a DC resistivity, and a weight-average particle diameter (Dw) of from 25 to 45 μm.

2. The carrier of claim 1, wherein the particulate core material is at least a member selected from the group consisting of Mn Mg ferrites, Mn Mg Sr ferrites and Mn Mg Ca ferrites.

3. The carrier of claim 1, wherein the electroconductive material comprises an electroconductive particulate material comprising a substrate formed of aluminum oxide; and a layer comprising indium oxide doped with zinc, coated on the substrate.

4. A developer, comprising the carrier according to claim 1 and a toner.

5. A process cartridge detachable from an image forming apparatus, integrally comprising at least:

an electrostatic latent image bearer; and an image developer comprising the developer according to claim 4, and configured to develop an electrostatic latent image formed on the electrostatic latent image bearer with the developer.

6. A carrier for developing an electrostatic latent image, comprising:

a particulate core material having a magnetism having developed spontaneous magnetization; and a covering layer comprising an electroconductive material, covering the surface of the particulate core material, wherein the electroconductive material comprises an electroconductive particulate material comprising a substrate formed of aluminum oxide; and a layer comprising indium oxide doped with zinc, coated on the substrate, wherein the carrier has an electrical resistivity Log R [Ωcm] of from 8.0 to 12.0 when measured by a method, comprising:

filling the carrier in a cell containing a pair of facing electrodes, each having a surface area of 2×4 [$cm^2$] with a gap of 2 [mm] therebetween; and applying a DC voltage of 1,000 [V] therebetween to measure a DC resistivity, and a weight-average particle diameter (Dw) of from 25 to 45 μm.

7. The carrier of claim 6, wherein the particulate core material is at least a member selected from the group consisting of Mn Mg ferrites, Mn Mg Sr ferrites and Mn Mg Ca ferrites.

8. A developer, comprising the carrier according to claim 6 and a toner.

9. A process cartridge detachable from an image forming apparatus, integrally comprising at least:

an electrostatic latent image bearer; and an image developer comprising the developer according to claim 8, and configured to develop an electrostatic latent image formed on the electrostatic latent image bearer with the developer.

* * * * *